US005794551A

United States Patent [19]

Morrison et al.

[11] Patent Number: 5,794,551

[45] Date of Patent: Aug. 18, 1998

[54] TANGENTIAL DRIVE NEEDLE BAR SHIFTER FOR TUFTING MACHINES

[75] Inventors: Gerald Morrison, Ringgold, Ga.; M. Steven Berger, Chattanooga, Tenn.

[73] Assignee: Modern Techniques, Inc., Ringgold, Ga.

[21] Appl. No.: 746,406

[22] Filed: Nov. 8, 1996

Related U.S. Application Data

[63] Continuation-in-part of Ser. No. 305,585, Sep. 14, 1994, abandoned.

[51] Int. Cl.[6] ..... D05C 15/00

[52] U.S. Cl. ..... 112/80.41

[58] Field of Search ..... 112/80.01, 80.23, 112/80.41; 74/89.22, 813 L; 198/832.2, 832.1, 571, 572

[56] References Cited

U.S. PATENT DOCUMENTS

| | | | |
|---|---|---|---|
| 2,873,822 | 2/1959 | Sloan . | |
| 3,762,232 | 10/1973 | Muller . | |
| 3,972,295 | 8/1976 | Smith . | |
| 4,010,700 | 3/1977 | Webb . | |
| 4,173,192 | 11/1979 | Schmidt et al. . | |
| 4,201,143 | 5/1980 | Jackson . | |
| 4,226,196 | 10/1980 | Booth . | |
| 4,285,287 | 8/1981 | Inman . | |
| 4,392,440 | 7/1983 | Ingram . | |
| 4,398,479 | 8/1983 | Czelusniak, Jr. . | |
| 4,399,758 | 8/1983 | Bagnall . | |
| 4,465,001 | 8/1984 | Ingram . | |
| 4,483,260 | 11/1984 | Gallant . | |
| 4,499,792 | 2/1985 | Tanabe | 74/825 |
| 4,566,346 | 1/1986 | Petiteau | 74/89.22 |
| 4,653,413 | 3/1987 | Bagnall | 112/80.41 |
| 4,690,252 | 9/1987 | Kottke et al. | 188/69 |
| 4,815,401 | 3/1989 | Bagnall | 112/80.41 |
| 4,829,917 | 5/1989 | Morgante et al. | 112/80.41 |
| 4,895,087 | 1/1990 | Amos | 112/80.18 |
| 5,058,518 | 10/1991 | Card et al. . | |
| 5,267,478 | 12/1993 | Stridsberg | 74/89.17 |

*Primary Examiner*—Paul C. Lewis
*Attorney, Agent, or Firm*—Pitts & Brittian, P.C.

[57] ABSTRACT

A tangential drive needle bar shifter for tufting machines. The tangential drive needle bar shifter includes a computer system for creating and storing selected carpet patterns and for controlling the operation of at least one motor which drives the needle bar. The motor includes an output shaft which rotates through a selected degree of rotation in a selected direction. At least one belt is driven by the rotation of the shaft to create lateral displacement of an engagement device is secured thereto. Displacement of the engagement device ultimately creates a shift of the needle bar. As the motor is actuated, the needle bar is shifted a distance proportional to the degree of rotation of the output shaft. A position locking mechanism, or indexer, is provided for preventing the needle bar from shifting farther then required and thus preventing the needles from colliding with the corresponding hooks.

19 Claims, 8 Drawing Sheets

TANGENTIAL DRIVE NEEDLE BAR SHIFTER FOR TUFTING MACHINES

This continuation in part application discloses and claims subject matter disclosed in our earlier filed application, Ser. No. 08/305,585, filed on Sep. 14, 1994 now abandoned.

TECHNICAL FIELD

This invention relates to the field of tufting machines. More specifically, this invention relates to a tufting machine provided with a needle bar shifter driven by a tangential drive device and having a timed indexing device.

BACKGROUND ART

In the field of tufting fabrics such as carpets and the like, it is well known that a needle bar having a plurality of needles is selectively shifted from side to side in discrete intervals in order to obtain a selected pattern. Typically, tufting machine needle bars are driven by a pair of pattern cams displaced at either end of the needle bar. Cam followers are secured at each end of the needle bar and are displaced between the pattern cams and the respective ends of the needle bar. Therefore, a fixed distance is defined between the distal ends of the two cam followers.

A distal end of each cam follower is positioned to engage the perimeter of its respective pattern cam. Each of the pattern cams defines a perimeter to cooperate with the perimeter defined by the other such that the respective cam followers are continuously engaged with the perimeter of the pattern cam. Around the perimeter of each cam, the radius is stepped up or down at specified intervals. As the radius increases, the cam follower, and hence the needle bar, is forced away from the center of the cam. A simultaneous and equal reduction in the radius of the other pattern cam allows the needle bar to move toward its center, and prevents the needle bar from moving any more than that distance.

It is well known that the change in radius of the pattern cams is equal to a selected number of discrete intervals at which the needle bar may move. Those intervals, or steps, are determined primarily by the spacing of the needles along the needle bar. The change in radius may be such that one, two, three, or any other selected plurality of steps may be made at one time. It is also well known that the length of the arc defined by the pattern cam at a given radius controls the number of stitches to be made by the needle bar at that position with respect to the centers of the pattern cams.

The pattern cams of the prior art are continuously in motion, as they are driven by the rotary drive of the tufting machine. Due to the nature of the drive mechanism, the pattern cams of the prior art may be driven only in a single direction. Further, due to the generally circular configuration of the pattern cams, it is well known that a single revolution of the pattern cams yields one pattern, after which, the position of the needle bar returns to the original position at which it started. The number of positions a needle bar will assume during a pattern cycle is dependent upon the magnitude of the circumference of the pattern cam and the rotational velocity of the pattern cams with respect to the reciprocal velocity of the needle bar.

This typical drive mechanism for tufting machine needle bars, as indicated, creates a number of restrictions regarding the creation of differing carpet patterns. Namely, one set of pattern cams will only produce one carpet pattern. In order to change patterns, new cams are required. It is well known that changing the cams is a time-consuming task, which, due to the down-time of the tufting machine, is inherently expensive. Further, if the selected pattern has not been used previously, new pattern cams must be manufactured. It is well known that pattern cams are relatively expensive.

Several tufting machines have been developed which include specific means for shifting the needle bar and/or backing material in order to accomplish a selected pattern. Further, shifting devices and indexing mechanism for other types of equipment have been developed to generate and limit lateral movement of heavy objects. Typical of the art are those devices disclosed in the following U.S. Letters Patents:

| U.S. Pat. No. | Inventor(s) | Issue Date |
|---|---|---|
| 2,873,822 | H. E. Sloan | Feb. 12, 1959 |
| 3,762,232 | F. Müller | Oct. 2, 1973 |
| 3,972,295 | R. P. Smith | Aug. 3, 1976 |
| 4,010,700 | H. E. Webb | Mar. 8, 1977 |
| 4,173,192 | H. A. Schmidt, et al. | Nov. 6, 1979 |
| 4,201,143 | S. P. Jackson | May 6, 1980 |
| 4,226,196 | D. Booth | Oct. 7, 1980 |
| 4,285,287 | B. E. Inman | Aug. 25, 1981 |
| 4,392,440 | G. L. Ingram | July 12, 1983 |
| 4,398,479 | P. A. Czelusniak, Jr. | Aug. 16, 1983 |
| 4,399,758 | A. F. Bagnall | Aug. 23, 1983 |
| 4,465,001 | G. L. Ingram | Aug. 14, 1984 |
| 4,483,260 | D. A. Gallant | Nov. 20, 1984 |
| 4,499,792 | T. Tanabe | Feb. 19, 1985 |
| 4,566,346 | M. R. Petiteau | Jan. 28, 1986 |
| 4,653,413 | A. Bagnall | Mar. 31, 1987 |
| 4,690,252 | J. Kottke, et al. | Sept. 1, 1987 |
| 4,829,917 | M. R. Morgante, et al. | May 16, 1989 |
| 4,895,087 | K. K. Amos | Jan. 23, 1990 |
| 5,058,518 | R. T. Card, et al. | Oct. 22, 1991 |
| 5,267,478 | L. Stridsberg | Dec. 7, 1993 |

Of these devices, those disclosed by Jackson ('143); Ingram ('440 and '001); Bagnall ('758 and '413); and Card, et al. ('518) each incorporates a pattern cam similar to that disclosed above.

The device disclosed by Schmidt, et al. ('192) provides a needle bar shifter which is activated hydraulically. In this device, hydraulic fluid is employed to move a piston member in a traverse direction to the stitching direction, the piston member being secured to the needle bar. As pressure is applied in a selected direction, the piston member, and therefore the needle bar, moves in a direction accordingly for as long as pressure is applied. The distance of travel is dependant upon the duration of the applied pressure. Similar to this device, the devices disclosed by Gallant ('260) and Morgante, et al. ('917) each include a hydraulically actuated needle bar shifter.

The device disclosed by Booth ('196) provides two needle bars which are spaced apart in the direction of the stitch. Booth provides a means for adjusting this distance. This type of adjustment does not provide for the lateral adjustment of the needle bars, and hence the pattern making.

Smith ('295) discloses a needle bar pattern shifting device having two oppositely disposed ratchets and pawls. When a shift of the needle bar is desired, the respective ratchet is engaged such that when the needle bar approaches the top of its cycle, it is shifted one step in the direction of the ratchet. However, only one step can be shifted in one revolution of the needle bar. Further, after the needle bar is shifted, there in nothing provided to prevent the needle bar from shifting laterally during its descent toward the backing material and until it ascends to engage the shifting device once again.

The device taught by Webb ('700) is an apparatus for delivering incremental linear motion to a needle bar. Rotation from a motor output shaft is used to turn a threaded rod in one direction or the other in order to convert the rotation to linear movement. Depending on the direction of rotation, the needle bar is shifted left or right with respect to the direction of travel of the backing material.

Czelusniak, Jr. ('479) discloses a tufting machine with shiftable and indexing needle bars, the needle bars being connected in an endless loop fashion by a sprocket chain on either end thereof. More specifically, the opposite ends of a first sprocket chain are connected to the corresponding first ends of two opposing needle bar elongate guide bars. In similar fashion, the opposite ends of a second sprocket chain are connected to the corresponding second ends of the two elongate guide bars. The needle bars move laterally in opposite directions one from the other due to the endless loop fashion with which they are connected. The endless loop arrangement of the '479 patent is provided specifically to move two needle bars in exactly equal and opposite directions simultaneously. The '479 device is not capable of shifting one needle bar independently from the other.

The Inman ('287) device is provided for shifting the needle bar in a transverse direction with respect to the direction of stitching. Inman provides a pair of journally connected control rods above and parallel to the needle bar, and one above the other. The lower control rod swings with respect to the upper control rod, thus moving the needle bar a proportionate distance in the same direction. As disclosed, the magnitude of swing is approximately equal to one step.

The Amos device ('087) is disclosed as being a device for controlling the starting and stopping of the tufting machine main shaft. This device is especially designed to control the operation of the main shaft when the associated A.C. motors are gradually speeding up or slowing down, and further for finally stopping the needle bar when it is in its uppermost portion of reciprocation.

Those devices disclosed by Müller ('232), Petiteau ('346), and Stridsberg ('478) each include a translation imparting device including an endless loop belt conveyor. As a motor is operated, the output shaft thereof is oscillated, thus oscillating the belt. A device secured to the belt is thus reciprocated in a linear direction. The device carried by the belt is cooperative with a workpiece or tool such that the workpiece or tool is reciprocated as a consequence of the operation of the motor. However, these devices do not provide a means for indexing, or precisely limiting the magnitude of travel of the device. Thus, in use with tufting carpets, there is no provision for ensuring that the needles will not collide with their respective hooks when the needle bar approaches the lower limit of its stroke.

Sloan ('822), Tanabe ('792), and Kottke, et al. ('252) each disclose indexing mechanisms for limiting rotation of a turn table or shaft. Sloan discloses a retractable bolt to lock the orientation of an indexing device such as a rotary turret in one of several discrete orientations. Similarly, Kottke, et al., teach a rotation locking device for locking the angular position of a tool part in a single orientation. Tanabe is provided for angularly positioning a turntable. A lock means is provided for locking the orientation of the turntable in one of nine positions. However, these indexing mechanisms do not teach the use thereof for indexing the lateral position of a linear device, and especially the position of at least one needle bar associated with a tufting machine.

None of the prior art references disclose the use of tangential drive means for shifting the needle bar of a tufting machine. Such a means would allow for the control of the needle bar in any selected pattern without requiring the changing of a pattern wheel or cam. This would create several immediate benefits including, but not limited to, saving down time otherwise required to change the cams, and saving money by obviating the need for separate pattern cams for each selected pattern.

Therefore, it is an object of this invention to provide a means for shifting a needle bar of a tufting machine using tangential force as an operative.

It is also an object of the present invention to provide such a means being driven substantially independent of the tufting machine drive means such that any selected tufting pattern may be achieved.

Another object of the present invention is to provide a means whereby the needle bar of a tufting machine may be tangentially shifted at any selected number of intervals in either direction lateral to the direction of travel of the backing material at any given instant when the needles carried by the needle bar are clear from any obstructions and will be clear from any obstructions throughout the shift.

Still another object of the present invention is to provide a means for indexing the shift of the needle bar in order to ensure that the needles will not collide with the hooks when the needle bar approaches the lower extent of its tufting cycle.

DISCLOSURE OF THE INVENTION

Other objects and advantages will be accomplished by the present invention which serves to shift a needle bar of a tufting machine a selected number of increments in a selected direction at a selected time using tangential forces derived from the rotation of at least one motor output shaft. A computer system is used to create and store selected carpet patterns to be produced using the tufting machine, and finally to control the operation of the motor which drives the needle bar.

A motor is provided having an output shaft which rotates through a selected degree of rotation in a selected direction as defined by the selected pattern in the computer. An endless loop belt or chain is driven by the rotation of the shaft. An engagement device is secured to the belt such that as the motor is actuated, the output shaft will be rotated a selected amount in a selected direction which then causes a lateral displacement of the engagement device. A shifting rod is connected to or is engaged by the engagement member, the shifting rod being connected to the needle bar. The needle bar is thus shifted as a result of the displacement of the engagement device and the shifting rod. Indirectly, then, the needle bar is shifted a distance proportional to the degree of rotation of the output shaft.

In order to prevent the needle bar from shifting farther then required, and thus to prevent the occurrence of the needles colliding with the corresponding hooks, a position locking mechanism, or indexer, is provided. The mechanical nature of the motor after it has achieved the prescribed rotation is to pass that rotation then come back from the other direction. This leads to the motor shaft oscillating about the desired location. Thus, the position locking mechanism is provided to arrest the rotation of the output shaft at the point where the desired rotation has been accomplished. The position locking mechanism may be mechanically, pneumatically, hydraulically, and/or electrically operated.

Mechanically-operated position locking mechanisms include the use of a sprocket member carried by one of the rotating gears or pinions, such as the gear attached to the transmission shaft and driven by the motor output shaft. An electrically-operated piston is actuated to engage a pin with one of the recesses defined by the sprocket. When so actuated, the rotation of the sprocket is arrested, and therefore, the movement of the needle bar is likewise halted. The arrangement of the sprocket and piston may be any conventional arrangement. The recesses defined by the sprocket may be so defined along an outside or an inside diameter. The piston and pin may be oriented co-planar with or perpendicular to the sprocket.

A pneumatic/electric position locking mechanism includes the use of a pneumatic piston connected to the needle bar in an orientation co-linear to the direction of travel of the needle bar. A servo valve may be operated to prevent the movement of the piston within its cylinder, thereby preventing the needle bar from further shifting. The servo valve is electrically operated, with operation being controlled by comparators which determine when a prescribed degree of motion has occurred.

A further indexer includes a piston carried by the distal end of the shifter rod. An outer sleeve receives the indexer and is rotatably mounted on the shifter. A timing belt is provided to rotate the outer sleeve about the piston one rotation per tufting cycle of the tufting machine. To this extent, the timing belt is driven by the tufting machine drive mechanism. A plurality of guides are carried by the outer sleeve, with the piston defining a plurality of equidistantly spaced walls having grooves defined therebetween. A portion of the walls are removed to allow later displacement of the guides as the needle bar is shifted. However, when the tufting machine cycle progresses to a point where the needles are initiating penetration of the backing material, the guides approach the leading edge of the walls are moved, if necessary in a lateral direction to prevent the needles from colliding with their respective hooks.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

Figure 1:
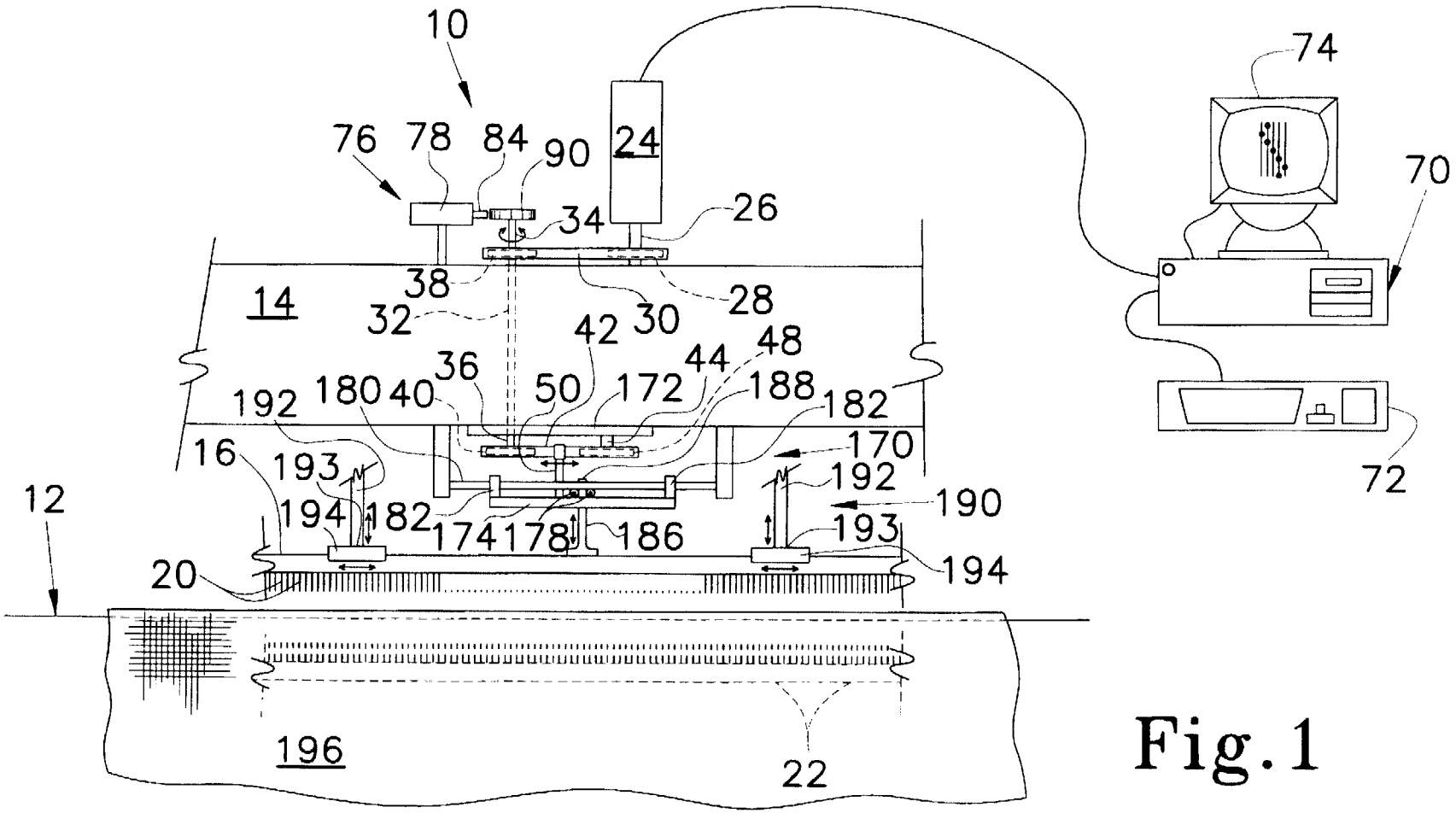
FIG. 1 is a front elevation view of one embodiment of the tangential drive needle bar shifter for tufting machines constructed in accordance with several features of the present invention and shown mounted on a conventional tufting machine.
Figure 2:
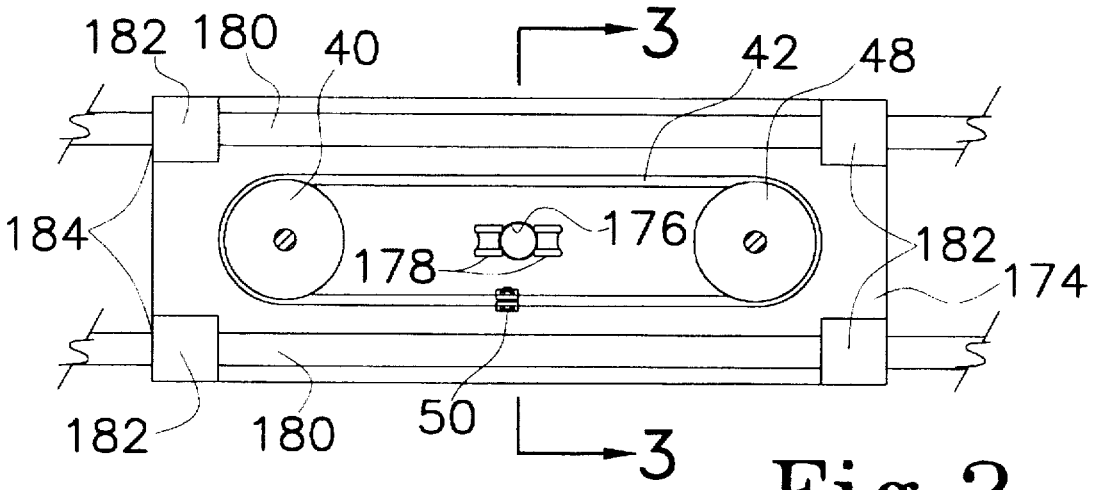
FIG. 2 is a partial top elevation view, in section, of the tangential drive needle bar shifter taken at 2—2 of FIG. 1.

A tangential drive needle bar shifter for tufting machines incorporating various features of the present invention is illustrated generally at 10 in the figures. The tangential drive needle bar shifter for tufting machines, or shifter 10, is designed for shifting a needle bar 16 of a tufting machine 12 a selected number of increments in a selected direction at a selected time. In the preferred embodiment, the shifter 10 is designed to shift the needle bar 16 using tangential forces derived from the rotation of at least one motor shaft 26.

In the preferred embodiment, a computer system 70 is used to create and store selected carpet patterns to be produced using a tufting machine 12. User input may be entered at a keyboard 72, or may be input from a floppy disk. The selected pattern may be viewed on a monitor 74. Under any circumstances, the monitor 74 may be used in a conventional fashion to assist the operator in utilizing the selected software.

The computer 70 is in electrical communication with at least one rotation imparting motor 24. In the preferred embodiment, the motor 24 is mounted on the existing housing 14 of the tufting machine 12. A preferred orientation of the motor 24 is illustrated in FIG. 1. The motor 24 includes an output shaft 26 which rotates through a selected degree of rotation in a selected direction as defined by the selected pattern in the computer 70. An endless loop chain or belt 30 is driven by the rotation of the shaft 26. The belt 30 may directly engage the shaft 26 or it may engage a pinion 28 connected concentrically to the shaft 26. It will be seen that any conventional arrangement may be incorporated. Therefore, it is not intended that the invention be limited to this disclosure.

The belt 30 in turn drives a gear 38 attached to a transmission shaft 32. As in any conventional gear and pinion arrangement, the gear-to-pinion diameter ratio will determine the rotation of the transmission shaft 32 as compared to the motor output shaft 26. The transmission shaft 32 extends through the tufting machine housing 14 toward a shifting plate assembly 170. A pinion 40 is carried by the distal end 36 of the transmission shaft 32.

The shifting plate assembly 170 includes a first plate 172 mounted under the housing 14 of the tufting machine 12 and above the needle bar 16. A support shaft 44 is carried by the tufting machine housing 14. A tension gear 48 is pivotally mounted to the distal end 46 of the support shaft 44 such that an endless loop-type chain or belt 42 may be closely received around the tension gear 48 and the pinion 40 carried by the distal end 36 of the transmission shaft 32. The tension gear 48 is positioned a distance away from the transmission shaft pinion 40 such that the belt 42 is kept taut. A pair of rods 180 are disposed under the first plate 172, each being placed in a parallel relationship with the other and with the needle bar 16. The rods 180 are mounted to either the tufting machine housing 14 as illustrated, or may alternatively be mounted to the first plate 172. A second plate 174 is disposed below the first plate 172 and carries a plurality of linear bearings 182 for receiving the rods 180. As illustrated, two linear bearings 182 are carried by the second plate 174 on each side thereof. Each linear bearing 182 defines a through opening 184 through which is received one of the rods 180 such that the second plate 174 may be reciprocated in a direction parallel to the rods 180, and thus in a direction parallel to the shifting of the needle bar 16. An engagement device 50 is secured at one end 54 to the belt 42 and at another end 58 to the second plate 174.

Figure 3:
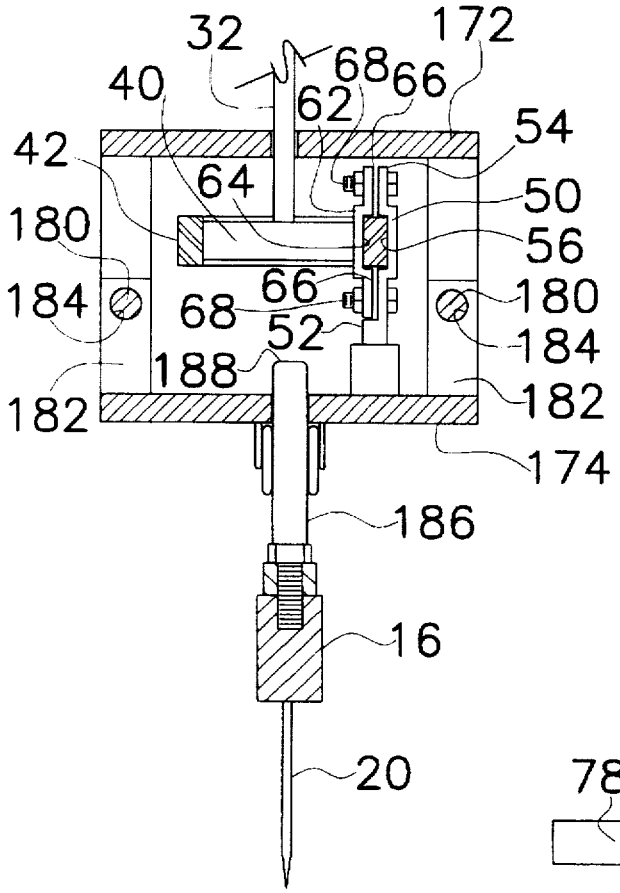
FIG. 3 is a partial side elevation view of the tangential drive needle bar shifter taken at 3—3 of FIG. 2.

As illustrated in FIG. 3, the engagement member 50 may include a rod 52 defining a depression 56 at a proximal end 54 and a threaded portion 60 at a distal end 58. The distal end 58 is secured to the second plate 174 The lateral depression 56 is dimensioned to receive a portion of the belt 42. A clamp member 62 defining a similar lateral depression 64 is placed in a cooperating fashion to receive an opposing side of the belt 42. Cooperating openings 66 are defined by the rod member 52 and clamp member 62 to receive fasteners 68 such as bolts. As shown, the combined depressions 56,64 of the engagement member rod 52 and the clamp member 62 are preferably less than the thickness of the belt 42 in order to insure a sufficient grip to prevent the belt 42 from slipping. It will be recognized that any other conventional method of securing the engagement member 50 to the belt 42 and/or to the second plate 174 may be used as well. Therefore, it is not intended that the present invention be limited to the disclosed embodiment.

The second plate 174 defines a through opening 176 for receiving the distal end of a shifting rod 186 carried by the needle bar 16. Two cam followers 178 are carried by the second plate 174 on opposing sides of the through opening 176. As the second plate 174 is shifted, the shifting rod 186 is also shifted, thus shifting the needle bar 16. The tufting machine 12 is provided with a conventional reciprocating mechanism 190 for reciprocating the needle bar 16 into and out of the backing material 196. As illustrated, the reciprocating mechanism 190 includes a reciprocating rod 192 disposed at either end of the needle bar 16. In order to allow the needle bar 16 to be shifted independently of the reciprocating mechanism 190, a linear bearing 194 is carried at the distal end 193 of each reciprocating rod 192. Thus, the needle bar 16 is allowed to move freely in a direction transverse to the backing material 196 with respect to the reciprocating mechanism 190. Because the needle bar 16 carries the shifting rod 186, the shifting rod 186 reciprocates vertically, thus reciprocating the shifting rod 186 within the through opening 176 defined by the second plate 174. The cam followers 178 thus assist in the reciprocation of the shifting rod 186 while also engaging the shifting rod 186 to shift the needle bar 16.

Thus, it will be seen that as the motor 24 is actuated, the output shaft 26 is rotated a selected amount in a selected direction. The output shaft 26 then, directly or indirectly through the associated pinion 28, drives the endless loop belt 30 a proportional distance, thus turning the gear 38. The gear 38 in turn rotates the transmission shaft 32 about its axis an equal rotational angle, which then turns the transmission shaft pinion 40. The transmission shaft pinion 40 then drives the belt 42 through a proportional degree of motion, the belt 42 being held in position by the tension gear 48. The engagement member 50 secured between the belt 42 and needle bar 16 is moved in a linear direction as the belt 42 is motivated, thus motivating the second plate 174, the shifting rod 186, and finally the needle bar 16 in the ultimately desired direction through the selected distance.

The selected distance through which the needle bar 16 travels is determined by the spacing of the individual needles 20 and corresponding hooks 22. It is essential that the needle bar 16 travel only in whole increments of that spacing in order to prevent the collision of the needles 20 and hooks 22. Due to the speed of reciprocation of the needles 20 and the force which is applied to them in order to cause that reciprocation, the tufting machine 12 can be severely damaged if the needles 20 and hooks 22 were to collide.

Due to the nature of motors 24 such as that used in the preferred embodiment, an indexer, or position locking mechanism 76 may be provided. Typically, when a servo motor 24 is commanded to turn a selected degree, the output shaft 26 will be rotated that degree with the momentum causing the shaft 26 to turn slightly farther. The motor 24 will then compensate by reversing the turn to again approach the target displacement. This continues until the target is approximately reached. This damping effect may cause the needle bar 16 to be slightly out of position when it is reciprocated toward the hooks 22 and can therefore cause the damage alluded to.

Figure 4:
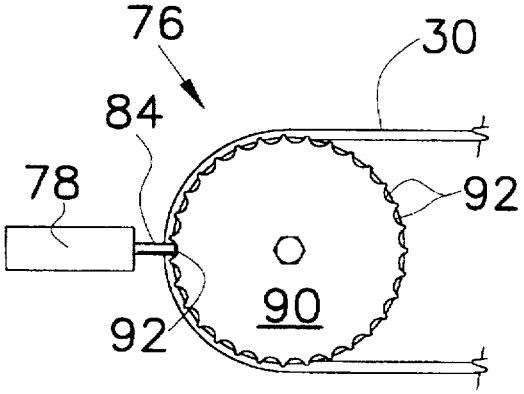
FIG. 4 is a top elevation view of a portion of the tangential drive needle bar shifter showing one embodiment of the position locking mechanism.

The position locking mechanism 76 may be one of several. As shown in FIG. 4, the position locking mechanism 76 may be a horizontally oriented piston member 78 with a protruding pin 84 directed toward a graduated disk or sprocket 90. The sprocket 90 is secured in relation to the gear 38 driven by the output shaft pinion 28 and belt 30. The piston member 78 is in electrical communication with the computer 70 so that as the selected distance through which the needle bar 16 is calculated to have been reached, the piston member 78 is actuated. When the piston member 78 is actuated, the pin 84 is extended to engage one of the recesses 92 defined by the perimeter of the sprocket 90, thus preventing further movement of the needle bar shifter 10 and thus the needle bar 16.

Figure 5:
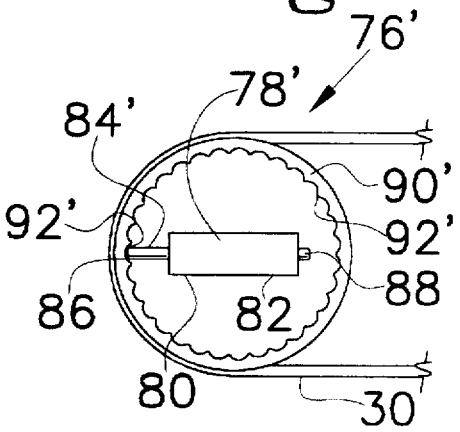
FIG. 5 is a top elevation view of a portion of the tangential drive needle bar shifter showing an alternate embodiment of the position locking mechanism.

FIG. 5 illustrates a position locking mechanism 76' similar to that shown in FIG. 4. In this embodiment, however, the piston member 78' is positioned centrally to the sprocket 90', with the recesses 92' being defined on an inner perimeter of the sprocket 90'. The pin member 84' defines first and second ends 86,88, each of which extends from a respective end 80,82 of the piston member 78'. As one end 86,88 is pushed toward a recess 92' in the sprocket 90', the other end 88,86 is being pulled away from the recess 92' within which it was previously engaged. In either embodiment illustrated, the recesses 92,92' defined by the perimeter of the sprocket 90,90' may have any selected geometric configuration. Therefore, it is not intended that the present invention be limited to recesses 92,92' defining arcuate configurations.

In this embodiment, a greater resolution may be achieved as opposed to the embodiment of FIG. 4, in the event an odd number of recesses 92 are defined around the perimeter of the sprocket 90. Shown are thirty-one (31) recesses 92 about the perimeters of the sprockets 90 in these two embodiments. In the embodiment of FIG. 4, the minimum degree of rotation is 360°/31, or approximately 11.6°, whereas, in FIG. 5, the minimum degree of rotation is approximately 5.8°. If there were an even number of recesses 92, however, because each recess 92 would be positioned directly across from another, the minimum degree of rotation in either embodiment would be substantially equal.

In the embodiment illustrated in FIG. 5, the time required for engaging the sprocket 90' will be substantially decreased due to the requirement of only a single stroke to disengage and re-engage the pin 84' from and with the sprocket 90'. It will be seen that as the piston member 78' is actuated to move the pin 84' from an engaged position, the pin 84' will simultaneously be moving toward the engaged position at the opposite end 86,88. In the embodiment shown in FIG. 4, the piston member 78 must be actuated to retract the pin 84 from engagement and then actuated again to extend the pin 84 into engagement with the sprocket 90. Thus, the time required to engage the pin 84' between selected locations may be reduced by fifty percent (50%) in the embodiment illustrated in FIG. 5.

Figure 6:
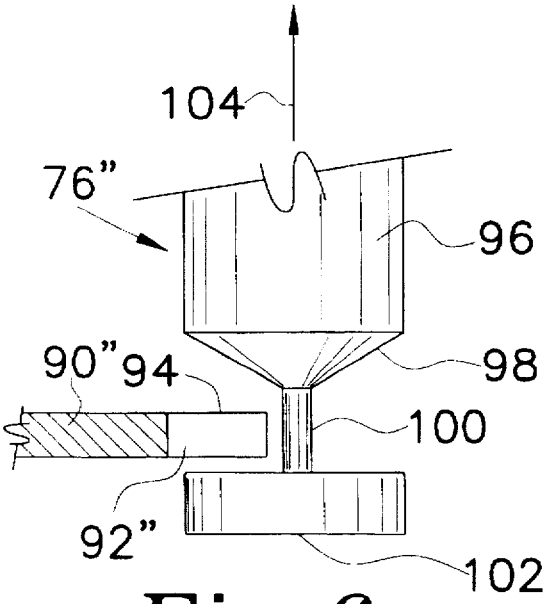
FIG. 6 is a side elevation view, partially in section, of a portion of the tangential drive needle bar shifter showing an alternate embodiment of the position locking mechanism being in an unlocked position.
Figure 7:
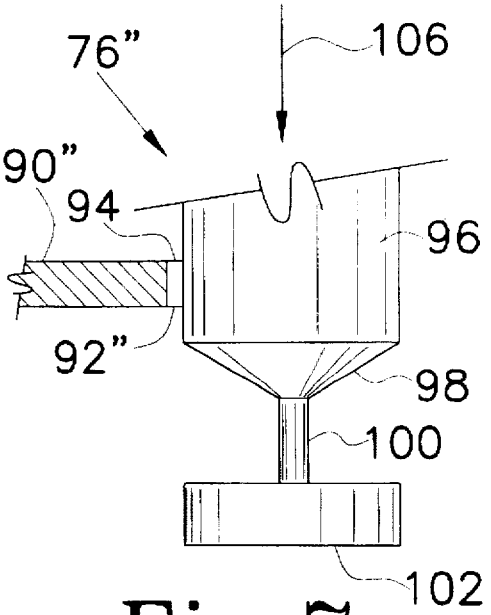
FIG. 7 is a side elevation view, partially in section, of a portion of the tangential drive needle bar shifter showing the alternate embodiment of the position locking mechanism of FIG. 6 being in a locked position.

In FIGS. 6 and 7, a vertically-oriented pin member 96 is illustrated. In this embodiment, the pin member 96 terminates in a frusto-conical configuration. An extending portion 100 is carried by the terminal end 98 of the pin 96 coaxially thereto. A head 102 may be carried by the extending portion 100.

When in the retracted position shown in FIG. 6 and indicated by the arrow 104, the sprocket 90" may move freely with respect to the pin 96. However, when the selected angle of rotation of the sprocket 90" is achieved, the piston member 78" is actuated to extend the pin member 96 as indicated by the arrow 106 in FIG. 7. When in the extended position, the sprocket 90" is prevented from further rotation. In the event the sprocket 90" is oriented such that the selected recess 92" does not coincide with the contour of the pin member 96, the frusto-conical configuration defined by the terminal end 98 of the pin member 96 will engage the top portion 94 of the sprocket 90" proximate the recess 92". As the pin member 96 is forced in the direction of the arrow 106, the slope of the pin member end 98 will cause the sprocket 90" to pivot to the selected position.

Figure 8:
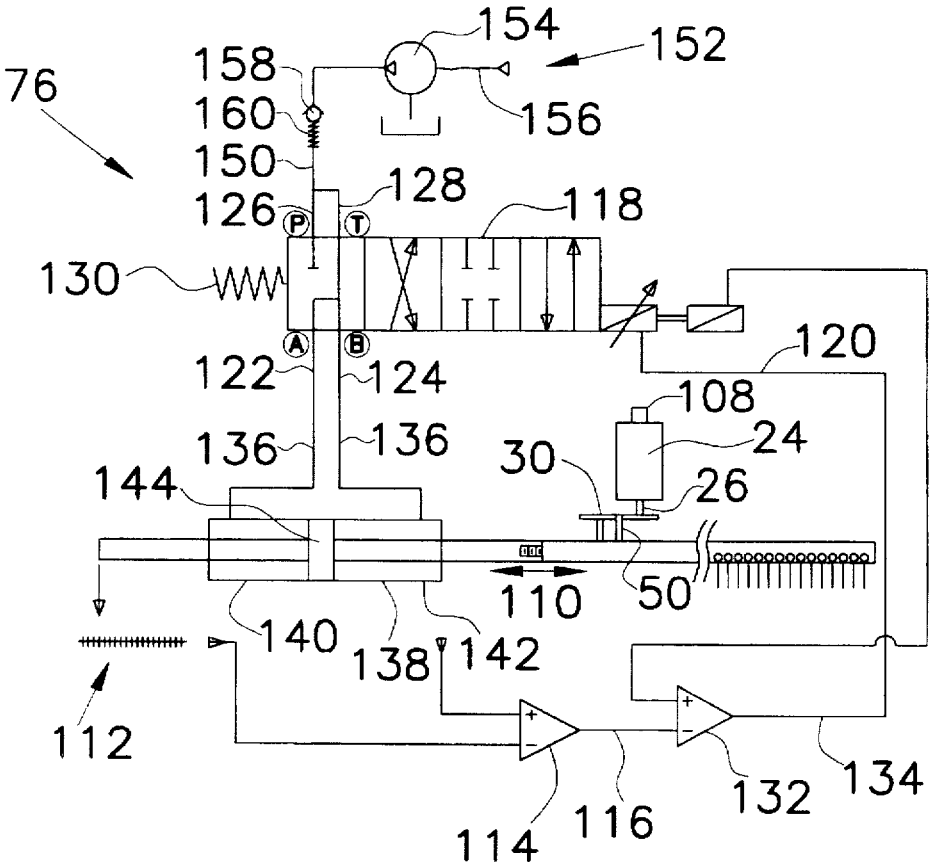
FIG. 8 is a schematic diagram of an alternate embodiment of the position locking mechanism of the tangential drive needle bar shifter.

FIG. 8 illustrates another alternate embodiment of the position locking mechanism 76. In this embodiment, a servo motor 24 is connected to the needle bar 16 and activated in response to the movement of the needle bar. An encoder 108 in electrical communication with the servo motor 24 controls the degree or rotation as in the previous embodiments. As the needle bar 16 is shifted in either direction, as indicated by arrows 110, a linear variable-differential transformer (LVDT) 112 detects the distance traveled by the needle bar 16. A signal is delivered from the LVDT 112 to a summing card 114 where the actual distance traveled is compared to the selected distance through which the needle bar 16 is to be shifted.

A servo valve 118 is connected in fluid communication with a horizontal cylinder 138 and in electrical communication with a power card 132. An electrical output 120 from the servo valve 118 is compared at the power card 132 with the output of the summing card 114. The power card output 132 is directed toward the servo valve 118 in order to control the operation thereof.

When the power card output 134 indicates that the needle bar 16 is in transition from one selected location to the next, the servo valve 118 will receive indication to allow a selected fluid to flow from the valve 118 to the horizontal cylinder 138 and from the horizontal cylinder 138 to the valve 118. The fluid may be any selected fluid such as air.

As indicated, a pair of conduits 136 connect the servo valve 118 to the horizontal cylinder 138. One conduit 136 provides fluid communication between the servo valve 118 at a first inlet/outlet 122 and a first end 140 of the horizontal cylinder 138. A second conduit 136 provides fluid communication between the servo valve 118 at a second inlet/outlet 124 and a second end 142 of the horizontal cylinder 138. A piston member 144 is carried within the horizontal cylinder 138 to prevent fluid communication between the first and second ends 140,142 thereof. The piston member 144 is carried by an extension member 146 secured to the needle bar 16. As indicated, the extension member 146 may be secured to the needle bar 16 in a conventional fashion such as by a threaded coupling 148.

When the needle bar 16 has been moved to the selected location, the distance traveled by the needle bar 16 as detected by the LVDT 112 will correspond to the selected distance output by the computer 70 via the encoder 108. Thus the summing card 114 will send the appropriate signal to the power card 132 which will in turn act to lock the servo valve 118 from further operation. Thus, the needle bar 16 will be stopped when it reaches the selected position and further movement such as that described previously will be arrested.

In order to maintain a pre-selected pressure within the servo valve 118, a pressure port 126 and a tank port 128 are provided. Fluid may be admitted into or expelled from the system through the pressure and tank ports 126,128. A spring member 130 is incorporated for maintaining the position of the valve. A supply line 150 is in fluid communication with the pressure and tank ports 126,128 and a fluid supply 152. As indicated, a pre-charge pump 154 may be used as a supply device, using air 156 as the selected fluid. A check valve 158 may be provided along the supply line 150 between the pressure port 126 and the supply 152 in order to maintain a selected pressure. To this extent, a spring 160 may be incorporated within the check valve 158 in order to determine the operating pressure.

It will be seen that the LVDT 112 control system illustrated in FIG. 8 as an alternate embodiment of the position locking mechanism 76 may be powered using the servo motor 24 used also to shift the needle bar 16. No other power source is required. Although it is shown as incorporating a servo valve 118, it will be understood that any other position locking device 76 such as those previously described may be incorporated as well.

Figure 9:
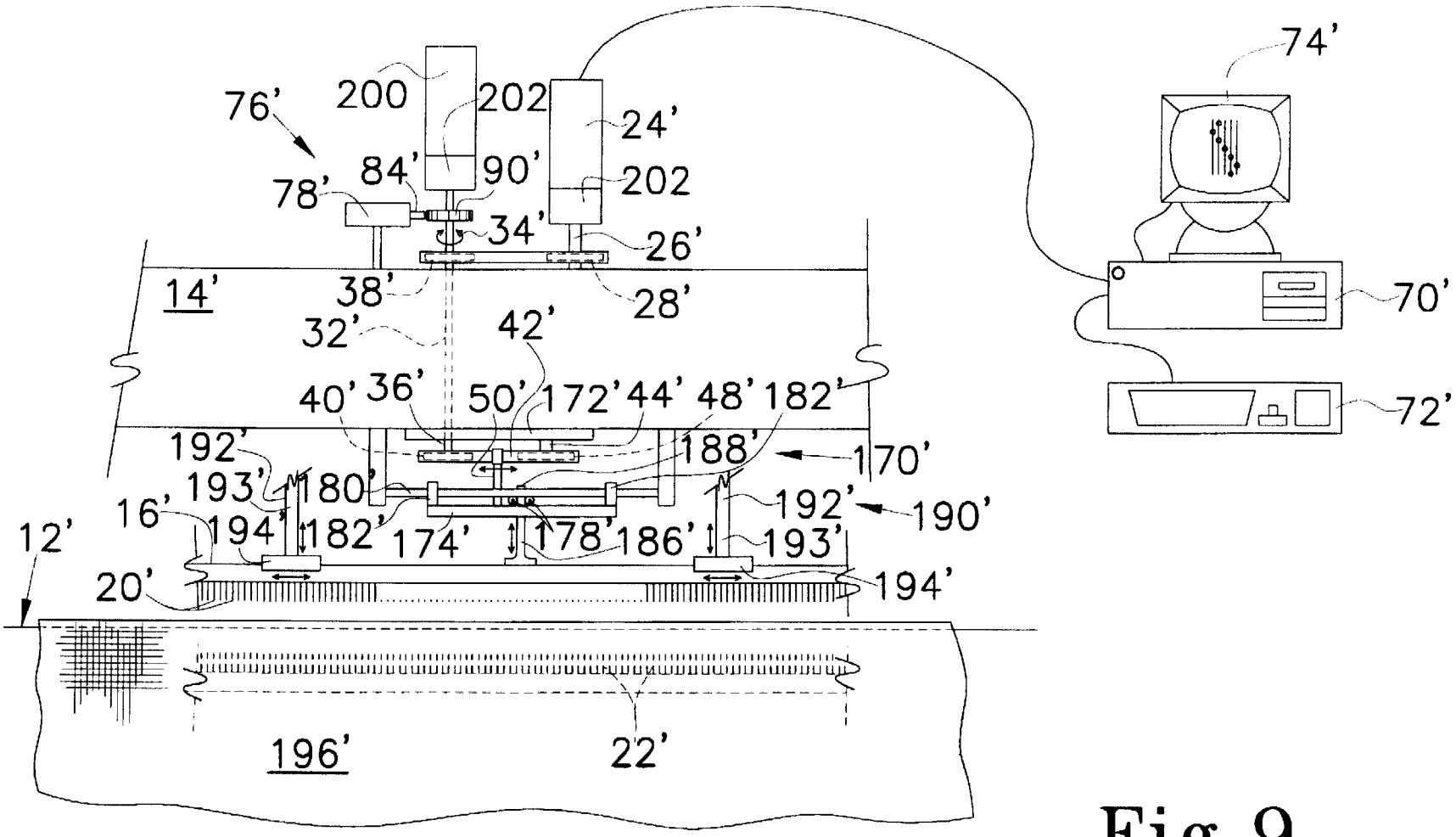
FIG. 9 is a front elevation view of an alternate embodiment of the tangential drive needle bar shifter for tufting machines constructed in accordance with several features of the present invention and shown mounted on a conventional tufting machine.

An alternate embodiment of the shifter 10 is illustrated at 10' in FIG. 9. Elements common to FIGS. 1 and 9 are labeled with like numerals followed by a "'" symbol. In this embodiment, a second motor 200 is illustrated as cooperating with the motor 24' in order to rotate the transmission shaft 32 and ultimately shift the needle bar 16. To this extent, a reducer 202 is associated with each of the motors 24',200. The reducers 202 serve to reduce the power output from the motors 24',200 such that each may work more efficiently while, in combination, yielding the same rotational output at the transmission shaft 32 as in the embodiment illustrated in FIG. 1 incorporating a single motor 24.

Although not shown, it is envisioned that more than one shifter 10 may be used to shift each needle bar 16. Thus, a plurality of shifters 10 may be carried by the tufting machine housing 14 and needle bar 16, with the shifters 10 being spaced apart along the needle bar 16. As in the embodiment shown in FIG. 9, each of the motors 24 associated with the shifters 10 would be required to output a smaller amount of power to the respective transmission shafts 32 in order to attain the desired shifting of the needle bar 16. The output required from each motor 24 would be approximately inversely proportional to the number of motors 24 incorporated.

Figure 10:
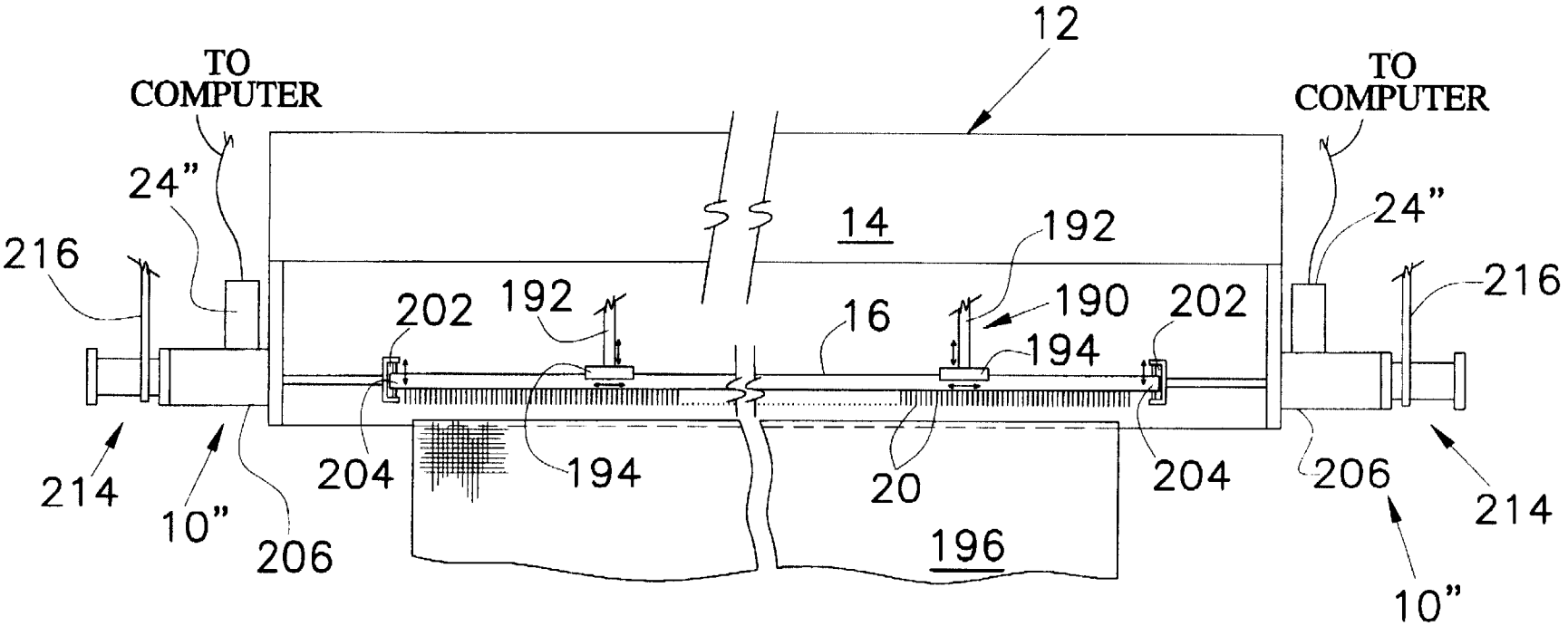
FIG. 10 is a front elevation view of a further preferred embodiment of the tangential drive needle bar shifter for tufting machines constructed in accordance with several features of the present invention and shown mounted on a conventional tufting machine.
Figure 11:
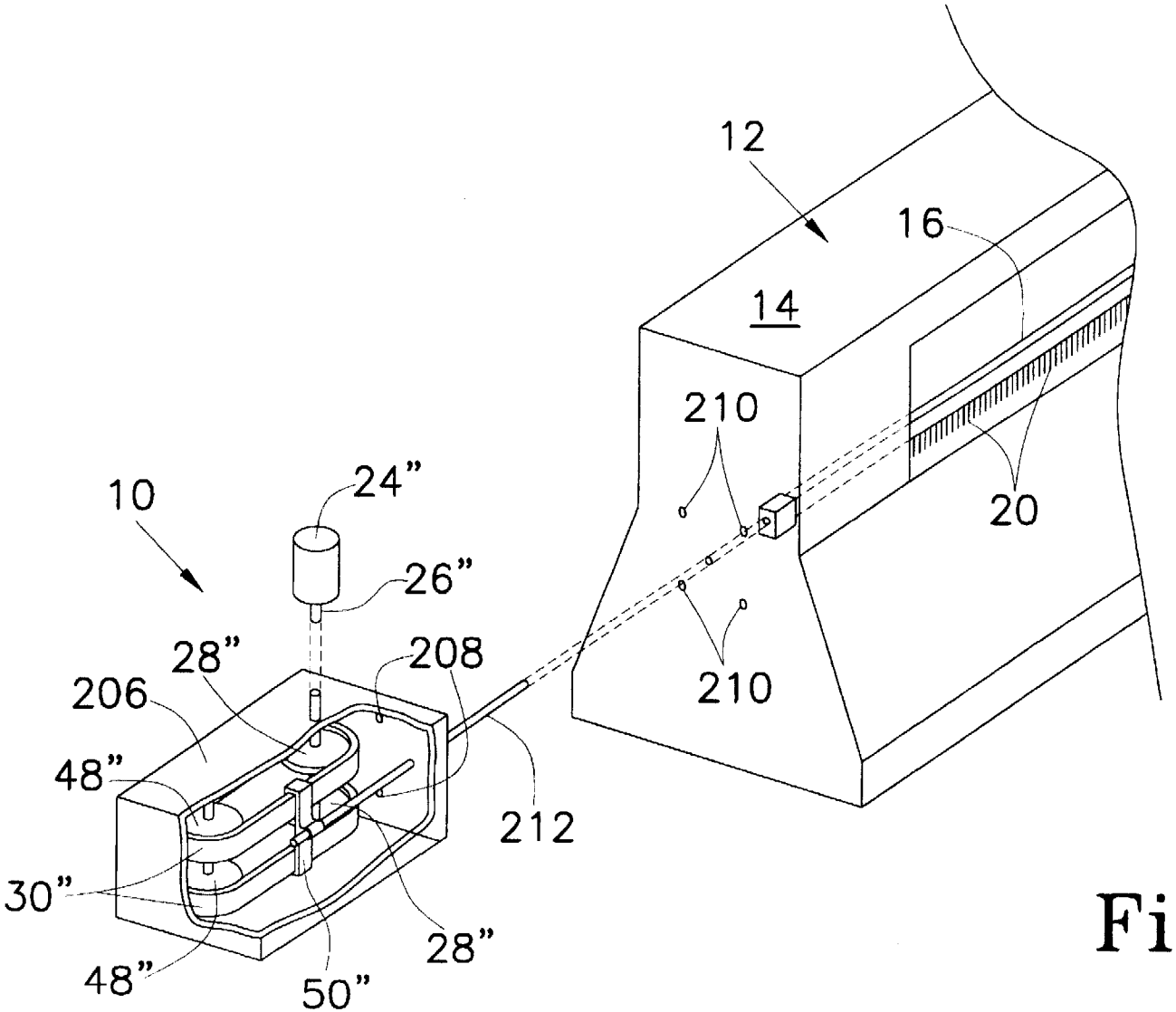
FIG. 11 is an exploded perspective view of the tangential drive needle bar shifter of FIG. 10 and the conventional tufting machine.

FIG. 10 illustrates yet another embodiment of the shifter 10 of the present invention, those elements common to the previous embodiments being labeled with like numerals, and with comparable elements being labeled with like numerals followed by a double prime. The shifter 10" illustrated in FIG. 10 is carried by the tufting machine housing 14 at an end thereof. As illustrated, a shifter 10" may be carried at each end, with one being provided for shifting one needle bar 16 and the other being provided for shifting a further needle bar 16. Such an arrangement is anticipated to be standard in that most tufting machines 12 currently in use include two needle bars 16 in order to create various patterns and effects in the tufted product. As best illustrated in FIG. 11, the shifter 10" includes an engagement device 50" configured to replace the shifting rod in a conventional tufting machine 12. For conventional tufting machines 12, the shifter 10" is easily retrofitted by removing the conventional shifter and replacing the same with the shifter 10" of the present invention. The shifting rod 212 incorporated in the shifter 10" of the present invention is secured to the needle bar 16 in a conventional manner. As illustrated in FIG. 10, a vertically oriented slide 202 is received within a linear bearing 204 to allow vertical displacement of the needle bar 16 with respect to the shifter 10". A linear bearing 194" is also carried at the distal end 193" of each reciprocating rod 192" to allow lateral displacement of the needle bar 16 with respect to the reciprocating mechanism 190".

The shifter 10" includes a housing 206 which is mounted on the tufting machine housing 14. Openings 208 are defined for receiving conventional fasteners for securement of the shifter housing 206 to the tufting machine housing 14. Preferably, the shifter housing openings 208 match the pattern of fastener receptors 210 defined by the tufting machine housing 14, thus making retrofitting older machines more time efficient and less expensive. A motor 24" is carried on top of the shifter housing 206, with an output shaft 26" extending downwardly into the shifter housing 206.

Figure 12:
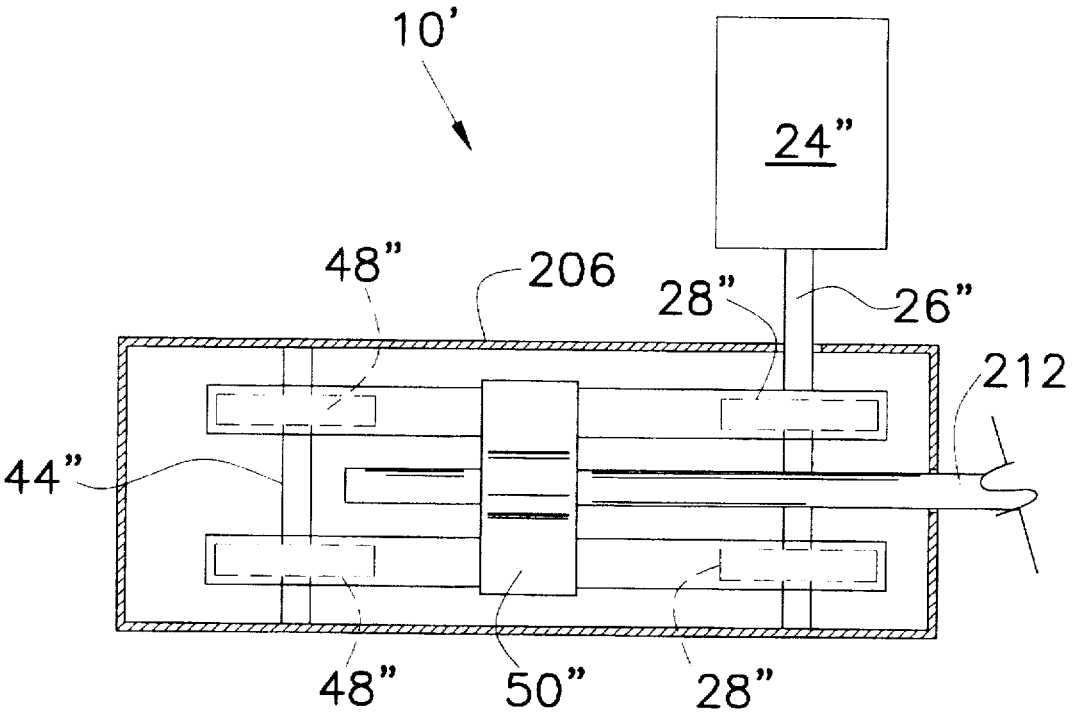
FIG. 12 is a front elevation view of the tangential drive needle bar shifter of FIG. 10.

As best illustrated in FIG. 12, the motor 24" includes an output shaft 26" which rotates through a selected degree of rotation in a selected direction as defined by the selected pattern in the computer 70". Two endless loop chains or belts 30" are driven by the rotation of the shaft 26". To this extent, two pinions 28" are carried by the shaft 26" in a spaced relationship with each other. The belts 30" each drive a corresponding tensioning gear 48" attached to a support shaft 44". An engagement device 50" is secured at one end 54" to one belt 30" and at another end 58" to the other belt 30" . A shifting rod 212 is secured to the central portion of the engagement device 50". Therefore, as the motor 24" is operated in a selected direction and through a selected angle, the output shaft 26" rotates the pinions 28" and consequently the belts 30" are driven accordingly. A portion of each belt 30" between the respective pinion 28" and the tensioning gear 48" moves in a linear direction transverse to the direction of travel of the backing material 196. The engagement device 50" is secured to each belt 30" between its respective pinion 28" and tensioning gear 48" such that as the pinion 28" is rotated and the belts 30" are driven, the engagement device 50" serves to move the shifting rod 212 which consequently shifts the needle bar 16 in the selected direction. Although two belts 30", with respective pinions 28" and tensioning gears 48", are illustrated and described, it will be understood that only one such belt 30" is required. However, with two belts 30" provided, the efficiency of the tufting machine 12 is improved. Specifically, the durability of each belt 30" is increased according to an increase in the surface area contacted by the engagement device 50". Further, in the event that one belt 30" fails, the other belt 30" will suffice until the one can be replaced or repaired. Further, as a belt 30" begins to wear, the engagement device 50" may be removed and the belts 30" rotated so that a new portion of the belt 30" may be engaged by the engagement device 50".

Figure 13:
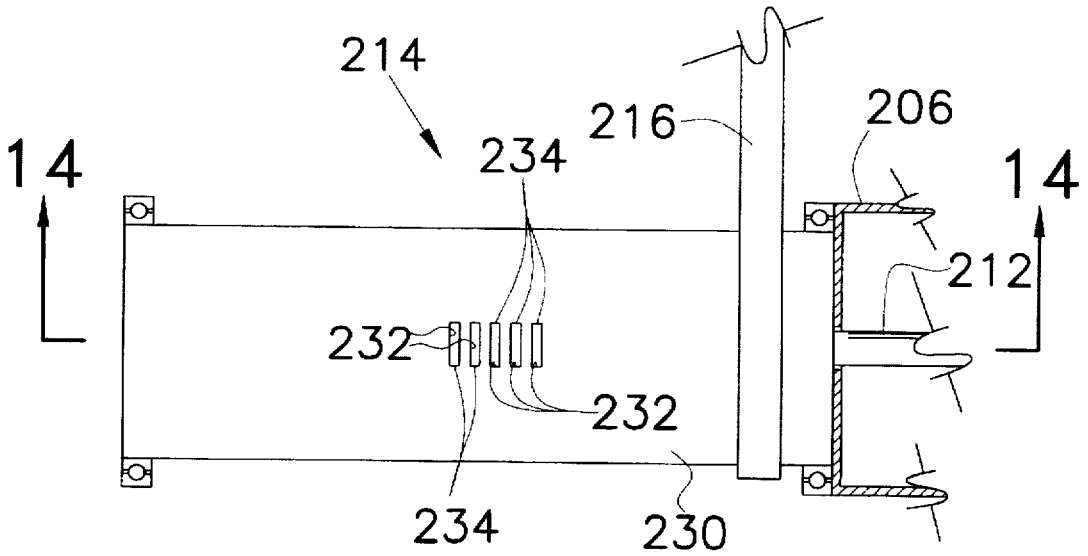
FIG. 13 illustrates a top plan view of a preferred embodiment of a position locking mechanism used in association with the tangential drive needle bar shifter of FIG. 10.
Figure 14:
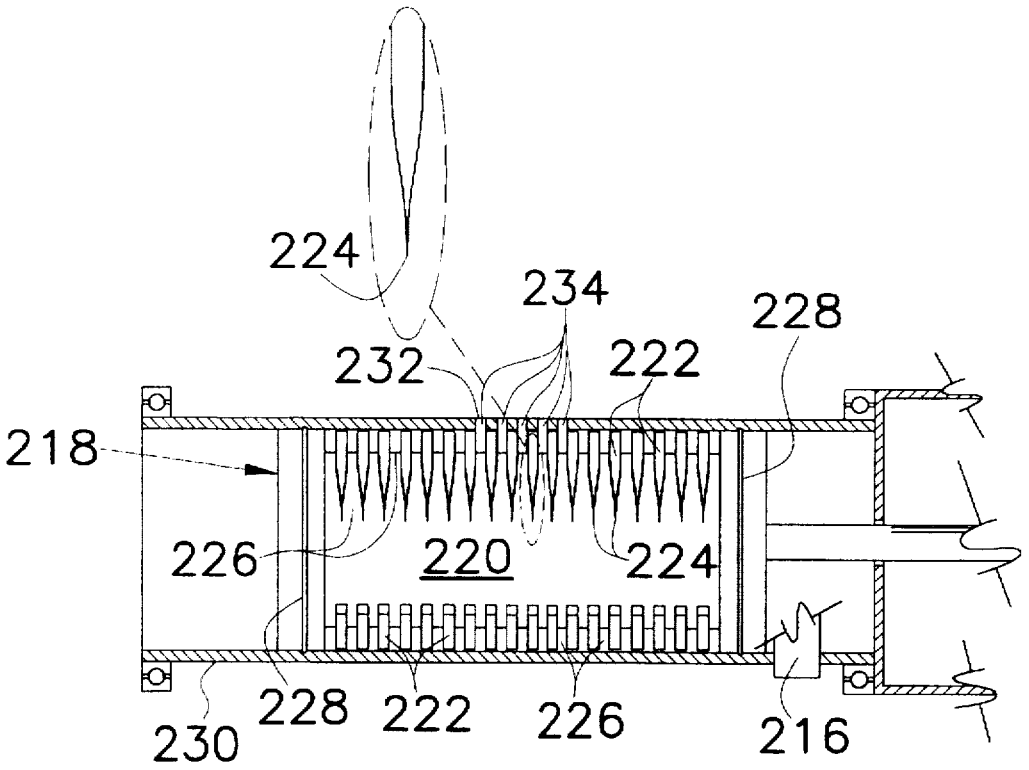
FIG. 14 is a top plan view, partially in section, of the position locking mechanism of FIG. 13.

FIGS. 13 and 14 illustrate a position locking mechanism, or indexer 214, used in association with the shifter 10" illustrated in FIGS. 10–12. As illustrated, the shifting rod 212 is extended through the shifter housing 206 and a piston 218 is secured to the distal end thereof. The piston 218 is received within an outer sleeve 230 rotatably mounted on the shifter housing 206. As the shifter 10" reciprocates the needle bar 16, the piston 218 is reciprocated within the outer sleeve 230. A timing belt 216 is driven by the tufting machine 12 and is received around the outer sleeve 230 of the indexer 214 such that as the tufting machine 12 is operated through one cycle, the outer sleeve 230 is turned one revolution. The piston 218 defines a recessed central portion 220 is which is formed a plurality of substantially "C"-shaped walls 222. The walls 222 are concentric with the piston 218 and are equidistantly spaced such as to form grooves 226 therebetween. The length of each wall 222 is determined by that portion of the tufting machine cycle in which it is undesirable to allow the needle bar 16 to shift. A seal 228 is disposed between each of the piston 218 and the outer sleeve 230.

Figure 15:
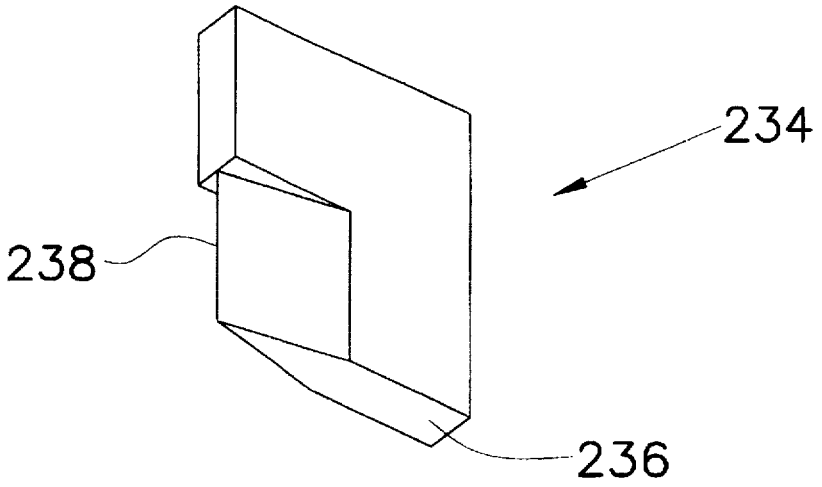
FIG. 15 is a perspective view of an indexer key incorporated in the position locking mechanism of FIG. 13.

The outer sleeve 230 defines at least one opening 232 for receiving a guide 234. The guide 234 received within an opening 232 is fixed therein to prevent relative movement thereof. In the illustrated embodiment, five such openings 232 are defined. A guide 234 of the preferred embodiment is illustrated in FIG. 15. The lower end 236 of the guide 234 defines a leading edge 238 at which point the opposing sides converge. Thus it can be seen that as the tufting machine 12 is operated, the timing belt 216 rotates the outer sleeve 230 about the piston 218, thus moving the guides 234 between respective walls 222 in the grooves 226 defined therebetween. When the outer sleeve 230 is rotated such that the guides 234 are no longer within a groove 226, the needle bar 16 may be shifted through operation of the shifter 10". In order to prevent the guides 234 from hitting the walls 222 and causing failure, the leading edge 224 of each wall 222 converges in a modified sine curve on either side to a point. If the needle bar 16 is not exactly positioned laterally, the indexer 214 will thus serve to move the needle bar 16 laterally until properly aligned. To this extent, the thickness of the guide 234 is substantially equal to the width of each groove 226. Thus, lateral movement of the needle bar 16 is substantially restricted during a substantial portion of the tufting machine cycle.

From the foregoing description, it will be recognized by those skilled in the art that a tangential drive needle bar shifter for tufting machines offering advantages over the prior art has been provided. Specifically, the tangential drive needle bar shifter provides a means for shifting a tufting machine needle bar using the tangential forces derived from the rotation of a selected motor. The tangential drive needle bar shifter of the present invention obviates the need for pattern cams and the like which are expensive and time-consuming to interchange. The tangential drive needle bar shifter of the present invention may be used in conjunction with a computer system in order to produce any selected pattern of movement of the needle bar. A position locking mechanism is provided for preventing the needle bar from moving to an unselected position in order to insure that the needles do not collide with the cooperating hooks.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention,

We claim:

1. A needle bar shifter for shifting one conventional needle bar of a tufting machine in a lateral direction with respect to a direction of travel of material being tufted by the tufting machine, more than one said needle bar shifter being used with more than one conventional needle bar to shift each conventional needle bar independently of each other conventional needle bar with respect to a direction and a distance of travel thereof, said needle bar shifter comprising:

a rotation imparting device including a pinion member;

a flexible member engaging said rotation imparting device proximate said pinion member and a support device, said flexible member being oscillated in a path about at least a portion of each of said rotation imparting device and said support device to impart movement of one needle bar in a direction tangential to said rotation imparting device, at least a portion of said flexible member defined between said rotation imparting device and said support device being disposed in a substantially linear configuration, said portion of said flexible member being substantially parallel to the direction of travel of the needle bar; and a single attachment member adapted to be disposed between said flexible member and the needle bar, said attachment member being secured to said portion of said flexible member and being adapted to be secured to the needle bar.

2. The needle bar shifter of claim 1 further comprising a position locking device for arresting movement of the needle bar when the needle bar has traveled a selected distance.

3. The needle bar shifter of claim 1 further comprising a computer-operated controller.

4. A needle bar shifter for shifting one conventional needle bar of a tufting machine in a lateral direction with respect to a direction of travel of material being tufted by the tufting machine, more than one said needle bar shifter being used with more than one conventional needle bar to shift each conventional needle bar independently of each other conventional needle bar with respect to a direction and a distance of travel thereof, said needle bar shifter comprising:

a rotation imparting device including a first pinion member;

a transmission shaft carrying a first gear member at a proximal end and a second pinion member at a distal end;

a first flexible member engaging said rotation imparting device proximate said first pinion member and said transmission shaft proximate said first gear member, said first flexible member being oscillated in a path about said first pinion member and said first gear member;

a support member adapted to be carried by a portion of the housing of the tufting machine, said support member having a second gear rotatably mounted thereto proximate a distal end;

a second flexible member secured between said second pinion member and said second gear member, said second flexible member being oscillated in a path about at least a portion of each of said second pinion member and said second gear member to impart movement of one needle bar in a direction tangential to said rotation imparting device, at least a portion of said second flexible member defined between said second pinion member and said second gear member being disposed in a substantially linear configuration, said portion of said second flexible member being substantially parallel to the direction of travel of the needle bar; and a single attachment member adapted to be disposed between said second flexible member and the needle bar, said attachment member being secured to said portion of said second flexible member and being adapted to be secured to the needle bar.

5. The needle bar shifter of claim 4 further comprising a position locking device for arresting movement of the needle bar when the needle bar has traveled a selected distance.

6. The needle bar shifter of claim 4 further comprising a computer-operated controller.

7. A needle bar shifter for shifting a conventional needle bar of a tufting machine in a lateral direction with respect to a direction of travel of material being tufted by the tufting machine, said needle bar shifter comprising:

a rotation imparting device including a pinion member;

an endless loop member engaging said rotation imparting device proximate said pinion member and a support device, said endless loop member being oscillated in a path about said rotation imparting device and said support device, at least a portion of said endless loop member defined between said rotation imparting device and said support device being disposed in a substantially linear configuration, said portion of said endless loop member being substantially parallel to the direction of travel of the needle bar;

an attachment member adapted to be disposed between said endless loop member and the needle bar, said attachment member being secured to said portion of said endless loop member and being adapted to be secured to the needle bar;

a shifting bar connected between said attachment member and the needle bar;

a position locking device for arresting movement of the needle bar when the needle bar has traveled a selected distance, said position locking mechanism including a piston carried by a distal end of said shifting bar, and an outer sleeve rotatably receiving said piston, a timing belt being disposed about said outer sleeve and a drive mechanism incorporated in the tufting machine, said outer sleeve being timed to rotate through one revolution during one tufting cycle of the tufting machine, said piston defining a plurality of equidistantly spaced walls having annular grooves defined therebetween, a length of said walls being proportionate to a portion of the tufting machine cycle defined when the needles carried by the needle bar penetrate the backing material until the needles exit the backing material, said outer wall being provided with at least one guide for being closely received in said grooves, said guide moving freely in a lateral direction when the needles are above the backing material in order to allow shifting of the needle bar, each of said plurality of walls being tapered to a leading edge, said guide defining a leading edge having tapered sides such that as said outer sleeve is rotated and said guide leading edge approaches said wall leading edge, the needle bar is shifted until properly aligned within the tufting machine, thus preventing failure within said position locking mechanism; and a computer-operated controller.

8. A needle bar shifter for shifting one conventional needle bar of a tufting machine in a lateral direction with respect to a direction of travel of material being tufted by the tufting machine, more than one said needle bar shifter being used with more than one conventional needle bar to shift each conventional needle bar independently of each other conventional needle bar with respect to a direction and a distance of travel thereof, said needle bar shifter comprising:

a rotation imparting device including a pinion member;

a flexible member engaging said rotation imparting device proximate said pinion member and a support device, said flexible member being oscillated in a path about at least a portion of each of said rotation imparting device and said support device to impart movement of one needle bar in a direction tangential to said rotation imparting device, at least a portion of said flexible member defined between said rotation imparting device and said support device being disposed in a substantially linear configuration, said portion of said flexible member being substantially parallel to the direction of travel of the needle bar;

an attachment member adapted to be disposed between said flexible member and the needle bar, said attachment member being secured to said portion of said flexible member and being adapted to be secured to the needle bar;

a position locking device for arresting movement of the needle bar when the needle bar has traveled a selected distance, said position locking device including a piston member and a sprocket member defining a plurality of recesses about a perimeter, said piston member having a selectively-extendable pin for engaging one of said plurality of recesses.

9. The needle bar shifter of claim 8 further comprising a computer-operated controller.

10. The needle bar shifter of claim 8 wherein said piston member is oriented in a direction parallel to an axis of rotation of said sprocket member.

11. A needle bar shifter for shifting one conventional needle bar of a tufting machine in a lateral direction with respect to a direction of travel of material being tufted by the tufting machine, more than one said needle bar shifter being used with more than one conventional needle bar to shift each conventional needle bar independently of each other conventional needle bar with respect to a direction and a distance of travel thereof, said needle bar shifter comprising:

a rotation imparting device including a pinion member;

a flexible member engaging said rotation imparting device proximate said pinion member and a support device, said flexible member being oscillated in a path about at least a portion of each of said rotation imparting device and said support device to impart movement of one needle bar in a direction tangential to said rotation imparting device, at least a portion of said flexible member defined between said rotation imparting device and said support device being disposed in a substantially linear configuration, said portion of said flexible member being substantially parallel to the direction of travel of the needle bar;

an attachment member adapted to be disposed between said flexible member and the needle bar, said attachment member being secured to said portion of said flexible member and being adapted to be secured to the needle bar;

a shifting bar connected between said attachment member and the needle bar; and a position locking device for arresting movement of the needle bar when the needle bar has traveled a selected distance, said position locking device including a piston carried by a distal end of said shifting bar and an outer sleeve rotatably receiving said piston, a timing belt being disposed about said outer sleeve and a drive mechanism incorporated in the tufting machine, said outer sleeve being timed to rotate through one revolution during one tufting cycle of the tufting machine, said piston defining a plurality of equidistantly spaced walls having annular grooves defined therebetween, a length of said walls being proportionate to a portion of the tufting machine cycle defined when the needles carried by the needle bar penetrate the backing material until the needles exit the backing material, said outer wall being provided with at least one guide for being closely received in said grooves, said guide moving freely in a lateral direction when the needles are above the backing material in order to allow shifting of the needle bar.

12. The needle bar shifter of claim 11 further comprising a computer-operated controller.

13. The needle bar shifter of claim 11 wherein each of said plurality of walls being tapered to a leading edge, and wherein said guide defines a leading edge having tapered sides such that as said outer sleeve is rotated and said guide leading edge approaches said wall leading edge, the needle bar is shifted until properly aligned within the tufting machine, thus preventing failure within said position locking mechanism.

14. A needle bar shifter for shifting a conventional needle bar of a tufting machine in a lateral direction with respect to a direction of travel of material being tufted by the tufting machine, said needle bar shifter comprising:

a rotation imparting device including a first pinion member;

a transmission shaft carrying a first gear member at a proximal end and a second pinion member at a distal end;

a first flexible member engaging said rotation imparting device proximate said first pinion member and said transmission shaft proximate said first gear member, said first flexible member being oscillated in a path about said first pinion member and said first gear member;

a support member adapted to be carried by a portion of the housing of the tufting machine, said support member having a second gear rotatably mounted thereto proximate a distal end;

a second flexible member secured between said second pinion member and said second gear member, said second flexible member being oscillated in a path about at least a portion of each of said second pinion member and said second gear member to impart movement of one needle bar in a direction tangential to said rotation imparting device, at least a portion of said second flexible member defined between said second pinion member and said second gear member being disposed in a substantially linear configuration, said portion of said second flexible member being substantially parallel to the direction of travel of the needle bar; and an attachment member adapted to be disposed between said second flexible member and the needle bar, said attachment member being secured to said portion of said second flexible member and being adapted to be secured to the needle bar;

a position locking device for arresting movement of the needle bar when the needle bar has traveled a selected distance, said position locking device including a piston member and a sprocket member defining a plurality of recesses about a perimeter, said piston member having a selectively-extendable pin for engaging one of said plurality of recesses.

15. The needle bar shifter of claim 14 further comprising a computer-operated controller.

16. The needle bar shifter of claim 14 wherein said piston member is oriented in a direction parallel to an axis of rotation of said sprocket member.

17. A needle bar shifter for shifting one conventional needle bar of a tufting machine in a lateral direction with respect to a direction of travel of material being tufted by the tufting machine, more than one said needle bar shifter being used with more than one conventional needle bar to shift each conventional needle bar independently of each other conventional needle bar with respect to a direction and a distance of travel thereof, said needle bar shifter comprising:

a rotation imparting device including a first pinion member;

a transmission shaft carrying a first gear member at a proximal end and a second pinion member at a distal end;

a first flexible member engaging said rotation imparting device proximate said first pinion member and said transmission shaft proximate said first gear member, said first flexible member being oscillated in a path about said first pinion member and said first gear member;

a support member adapted to be carried by a portion of the housing of the tufting machine, said support member having a second gear rotatably mounted thereto proximate a distal end;

a second flexible member secured between said second pinion member and said second gear member, said second flexible member being oscillated in a path about at least a portion of each of said second pinion member and said second gear member to impart movement of one needle bar in a direction tangential to said rotation imparting device, at least a portion of said second flexible member defined between said second pinion member and said second gear member being disposed in a substantially linear configuration, said portion of said second flexible member being substantially parallel to the direction of travel of the needle bar;

an attachment member adapted to be disposed between said second flexible member and the needle bar, said attachment member being secured to said portion of said second flexible member and being adapted to be secured to the needle bar;

a shifting bar connected between said attachment member and the needle bar; and a position locking device for arresting movement of the needle bar when the needle bar has traveled a selected distance, said position locking mechanism including a piston carried by a distal end of said shifting bar and an outer sleeve rotatably receiving said piston, a timing belt being disposed about said outer sleeve and a drive mechanism incorporated in the tufting machine, said outer sleeve being timed to rotate through one revolution during one tufting cycle of the tufting machine, said piston defining a plurality of equidistantly spaced walls having annular grooves defined therebetween, a length of said walls being proportionate to a portion of the tufting machine cycle defined when the needles carried by the needle bar penetrate the backing material until the needles exit the backing material, said outer wall being provided with at least one guide for being closely received in said grooves, said guide moving freely in a lateral direction when the needles are above the backing material in order to allow shifting of the needle bar.

18. The needle bar shifter of claim 17 further comprising a computer-operated controller.

19. The needle bar shifter of claim 17 wherein each of said plurality of walls being tapered to a leading edge, and wherein said guide defines a leading edge having tapered sides such that as said outer sleeve is rotated and said guide leading edge approaches said wall leading edge, the needle bar is shifted until properly aligned within the tufting machine, thus preventing failure within said position locking mechanism.

* * * * *